United States Patent [19]

Landsman et al.

[11] 4,226,339

[45] Oct. 7, 1980

[54] INVERTIBLE SPRAY DISPENSING SAFETY CAP

[76] Inventors: Irving Landsman, 3530 Henry Hudson Pkwy., Riverdale, N.Y. 10463; Mark Landsman, 12 Cranford Dr., New City, N.Y. 10956

[21] Appl. No.: 20,908

[22] Filed: Mar. 16, 1979

[51] Int. Cl.[3] ..... B65D 83/14

[52] U.S. Cl. ..... 222/182; 222/402.11

[58] Field of Search ..... 222/182, 402.11, 402.13; 239/288, 288.3, 288.5

[56] References Cited

U.S. PATENT DOCUMENTS

| | | | |
|---|---|---|---|
| 2,707,968 | 5/1955 | Efford | 222/182 X |
| 3,168,059 | 2/1965 | Germann | 222/182 X |
| 3,247,849 | 4/1966 | Wise et al. | 222/182 X |
| 3,765,573 | 10/1973 | Landsman | 222/182 |
| 3,935,974 | 2/1976 | Weyn | 222/182 X |

*Primary Examiner*—F. J. Bartuska

*Attorney, Agent, or Firm*—Wolder, Gross & Yavner

[57] ABSTRACT

A spray dispenser cap for assisting in the actuation of spray or aerosol containers and for preventing actuation thereof during storage. The cap is invertible so that in a safety storage position, the user is unable to place his finger in a position for actuation of the spray or aerosol plunger; and in a user position, the user is able to actuate the container plunger for dispensing the contents. The cap is compatible with existing structures.

5 Claims, 8 Drawing Figures

INVERTIBLE SPRAY DISPENSING SAFETY CAP

The invention relates primarily to spray and aerosol containers and more particularly to caps therefor.

For purposes of clarity, the present invention is best described with reference to dispensers for shaving cream lather, but it is to be understood that its applicability is to any type of container dispenser which uses either aerosol, spray, or pumping action to remove the contents from the container.

A common type of dispenser for shaving cream comprises a generally cylindrical container which tapers at the top into an attachment for a spray or pumping cap. The cap includes an outer housing, into which fits a depressable plunger surface. The plunger surface, when depressed, causes the contents to move from within the cylindrical container to an outlet port protruding through the cap outer housing. A larger cap fits over the cap outer housing and plunger surface for storage purposes in order to generally terminate the container at its upper end in a structure which continues the cylindrical shape of the can. This larger cap is easily removable by children and the plunger surface either easily depressable intentionally or easily depressable accidentally to cause an unwanted mess. In other words, there is no provision whatsoever for preventing undesirable access to the contents of the container. This is particularly important when harmful substances are contained.

The art has progressed so that the problem has been recognized as mentioned above. Manufacturers have thereby provided a disc-shaped smaller cap to fit over the plunger surface onto the top of the cap outer housing in order to prevent unwanted access thereto. This disc-shaped cap includes a closing end surface with a hollowed cavity defined therebeneath. The smaller cap fits into the cap outer housing with a snap-on action and defines an opening for accommodating the outlet port. The smaller cap is made of a stiff material, but invariably provides enough flexibility in its end surface structure so that a pressing thereof may very well actuate the dispensing of the contents of the container.

Accordingly, a primary object of the present invention is to provide a cap structure for a spray, pump or aerosol container which may be inverted to provide both a storage and use position.

A further object of the present invention is to provide a cap structure which enables adoption of a presently available dispenser cap in order to make such available cap invertable to both a use and storage position.

These and other objects of the present invention are provided in an aerosol, pump or like cap structure which features a generally cylindrical elongated housing which includes upper and lower container connecting openings defined by end lips. Within the housing, a plunger assembly is included. The plunger assembly comprises an elongated outlet port extending through the outer housing and terminating inside the housing just below a connected plunger disc which extends radially within the cylindrical housing, and yet with clearance between said surface and the inner walls of the housing. At the termination of the outlet port at the center point of the housing, and within the housing, the outlet port forms a perpendicular, downwardly depending access opening for fitting the upwardly projecting dispenser stem of the container. The inner walls of the housing also include stop means for preventing motion in one direction (opposite to that motion desired for actuation) of the plunger surface. Furthermore, the outer walls of the housing include means for facilitating handling of the cap so that it is easily removed and inverted to change from use position to storage position, or vice versa.

Alternatively, the structure of the present invention includes merely the upper portion of the cap set forth in the immediately preceding description with lip and snap-on means provided so that an existing cap structure can be adapted to the structure of the present invention. In other words, approximately half of the above described housing including stop means and means for facilitating handling are provided with an upper end defined by an end lip. This one end lip is made so that the entire cap structure, including the adapting half, may be inverted to provide a storage position.

Other objects, features and advantages of the present invention will be apparent by reference to the following more detailed description of a preferred, but nonetheless illustrative, embodiment with reference to the accompanying drawings wherein.

Figure 2:
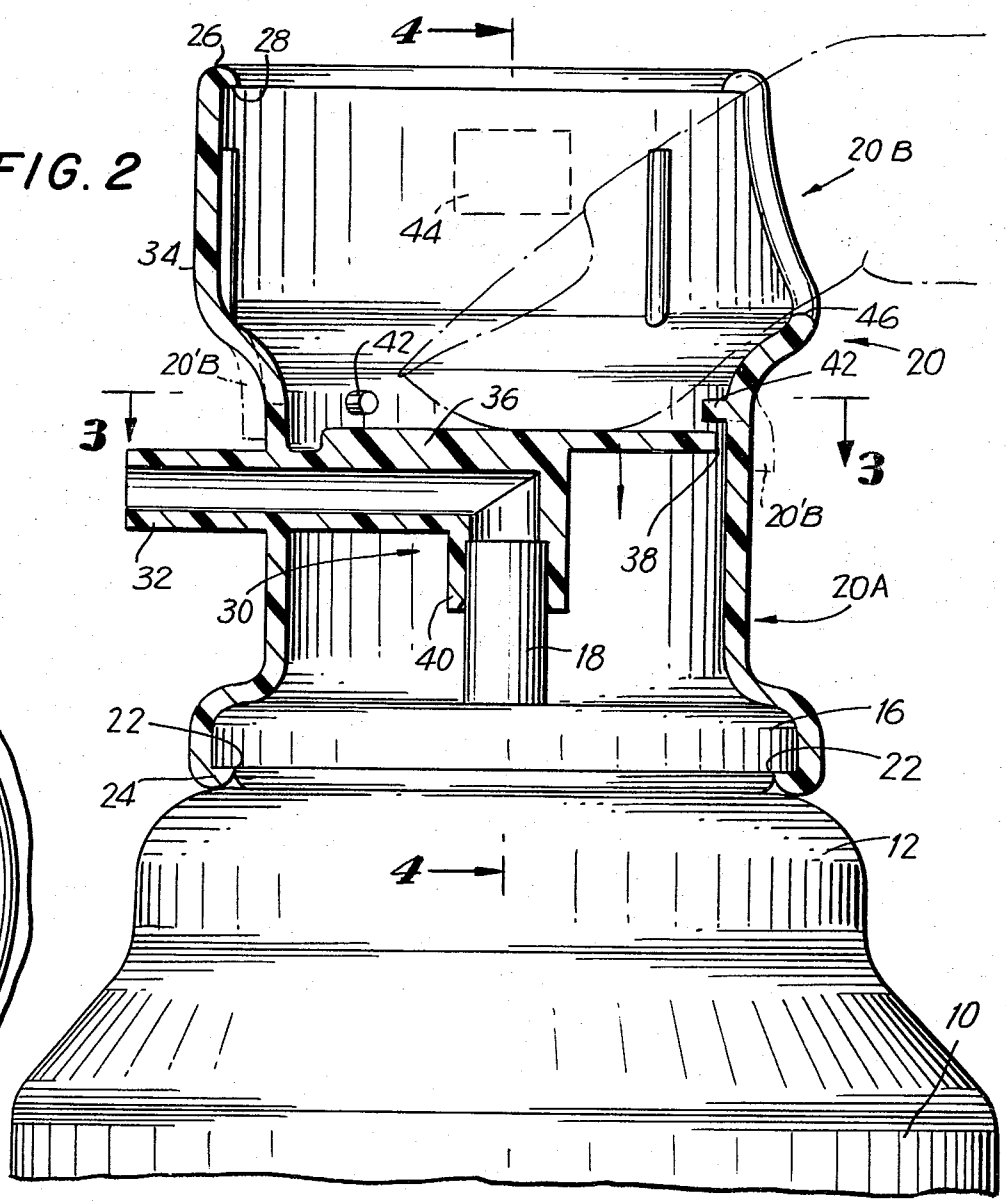
FIG. 2 is a partial sectional view, showing the cap of the present invention in section and an alternative embodiment in ghost lines, the cap being in position for actuation of the container to remove its contents.
Figure 1:
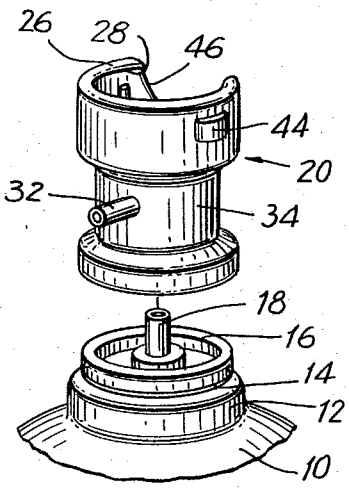
FIG. 1 is an isometric view showing the top portion of a container, including upwardly projecting dispenser stem and a cap according to the present invention for fitting thereon.
Figure 3:
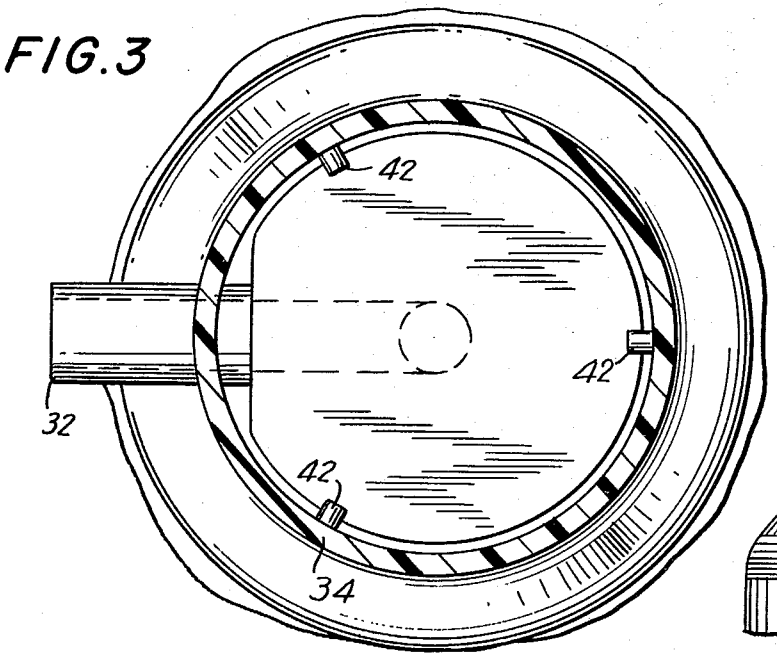
FIG. 3 is a sectional view of the cap of FIG. 2, taken along the line 3—3 thereof.

Referring to the drawings, and particularly FIGS. 1–5 thereof, a container 10 terminates at its upper end in a necked-down portion 12, upwardly extending from which is a collar 14 terminating at its upper extent in a connecting bead 16. Protruding from the middle of the top of the container is an upwardly projecting stem 18, downward pressure on which will cause removal of the contents of container 10.

The cap of the present invention, generally designated 20, includes a downwardly facing opening 22 defined by a lower lip 24 for fitting over bead 16 of the container top. Likewise, the upper end of cap 20 terminates in upper lip 26 defining upper opening 28, which also is structured to fit over bead 16 in a snap-on connection for the inverted storage position of cap 20. As shown particularly in FIG. 2, the inner structure of cap 20 includes a plunger assembly generally designated 30, which includes an elongated outlet port 32 protruding through the outer housing 34 of cap 20. The elongated outlet port terminates at the center of housing 34 just below a connected plunger disc 36, which extends radially within the outer housing, and yet with partial clearnace 38 between said surface and the inner walls of the housing. At the inner termination of outlet port 32, at the center of housing 34, is a perpendicular, downwardly depending access tube 40 for fitting the upwardly projecting dispensing stem 18. The inner walls of housing 34 include projecting stop means 42, whose function will be described hereinafter.

The outer surface of housing 34 provides projecting handles 44 for facilitating handling and inverting of cap 20. Also, the upward extent of cap 20 defines finger access opening 46 (FIGS. 1 and 4) for enabling access to plunger disc 36 in the use position of cap 20.

Figure 5:
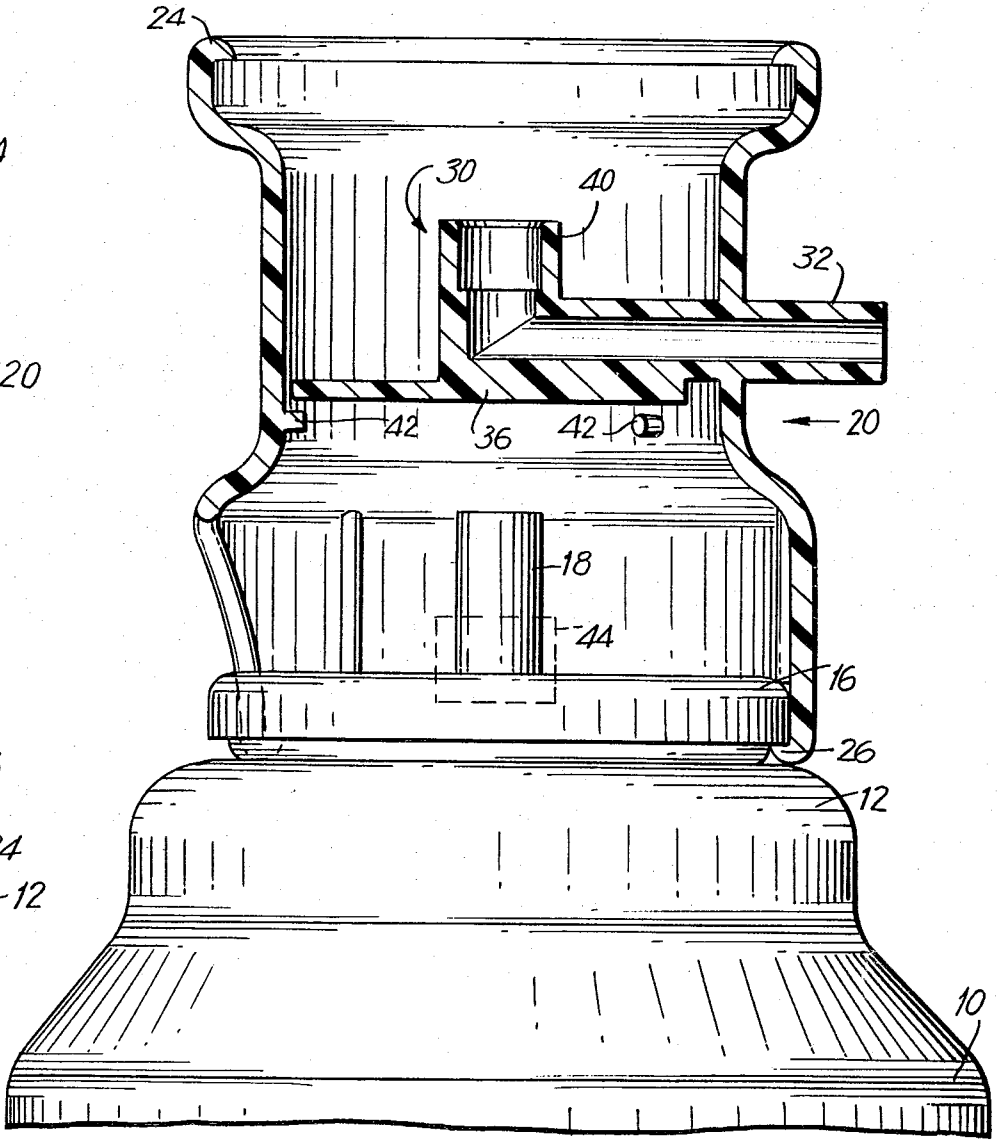
FIG. 5 is a view similar to that of FIG. 4, but showing the cap of the present invention providing a storage position.
Figure 4:
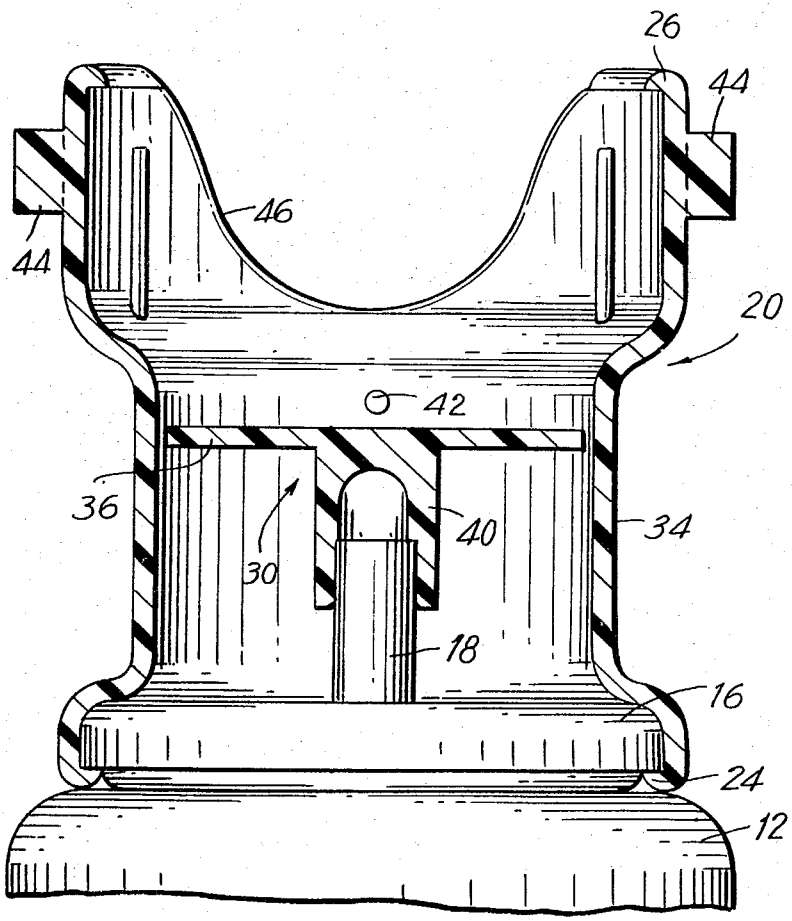
FIG. 4 is a side sectional view taken along the line 4—4 of FIG. 2 and showing particularly a finger access opening for the cap of the present invention.

Referring particularly to FIGS. 4 and 5, the use and storage positions, respectively, of cap 20 are shown. FIG. 4 shows the cap attached to container 10 such that plunger assembly 30 has its access tube 40 mated with dispensing stem 18. In this position, a depression of plunger disc 36 will actuate dispensing of the contents of container 10 and stop means 42 will not hinder the motion of plunger disc 36. Depression of plunger disc 36 is caused by inserting the user's finger through finger access opening 46 so that the tip of the finger rests comfortably on plunger disc 36. In order to provide the storage position of FIG. 5 after use according to FIG. 4, handles 44 are grasped and cap 20 inverted to assume the orientation of FIG. 5 wherein lip 26 engage bead 16 of the container top. Of course, in the orientation of FIG. 4, lip 24 had engaged bead 16 of the container cap. After inversion to the position of FIG. 5, plunger assembly 30 is positioned so that neither plunger disc 36 nor access tube 40 are in contact with dispensing stem 18. Furthermore, stop means 42 are in position with respect to plunger disc 36 such that any motion of plunger disc 36 will be quickly terminated. Plunger disc 36 is unable therefore, to reach dispensing stem 18 for actuating dispensing of the container contents. Such a position is child-proof and accident-proof with respect to any potential user.

Alternatively, referring to FIG. 2, if the lower half 20A of dispenser cap 20 is provided with the container and upper half 20B is provided according to the present invention, ghost lines indicate a lower structure 20'B is configured to snap on to lower half 20A in order to provide stop means 42, handles 44 and finger access opening 46. The entire cap 20, including parts 20A and 20B, is thereby invertable to provide the configuration shown in FIG. 5 for storage, as well as the configuration of FIG. 2 (with ghost lines) for use.

Figure 8:
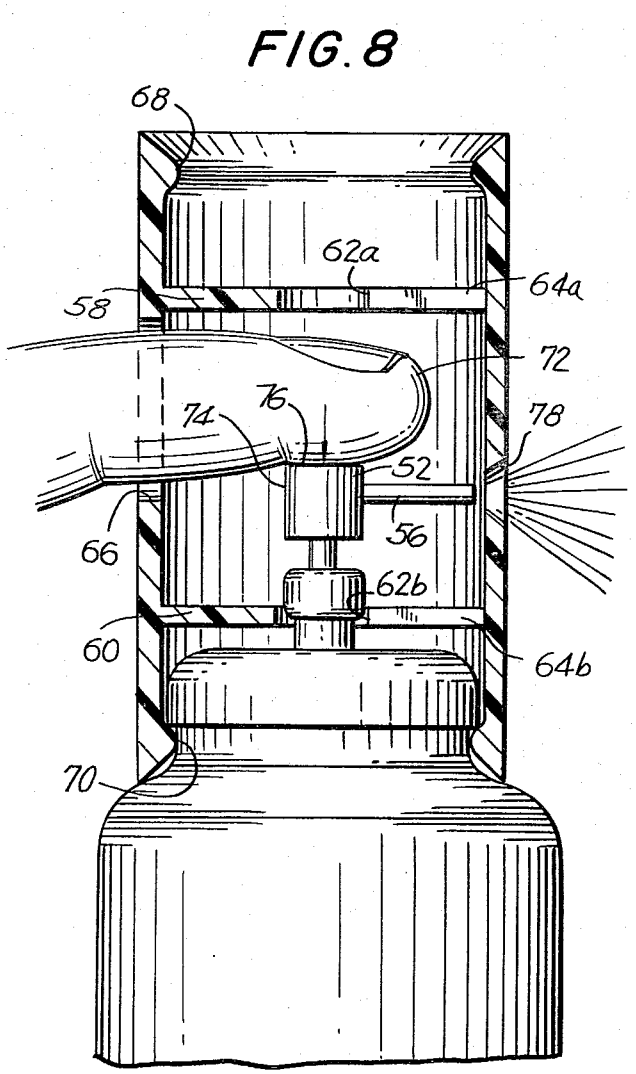
FIG. 8 is a view similar to that of FIG. 7, but showing the cap in use or actuation position.
Figure 7:
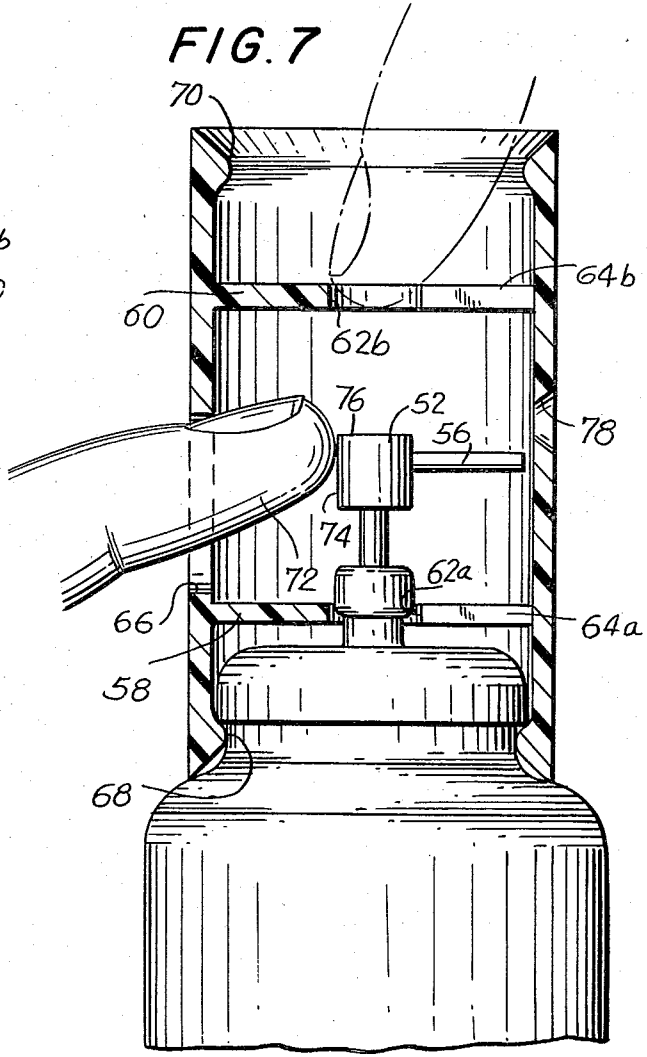
FIG. 7 is a partial sectional view showing the cap of FIG. 6 in storage position.
Figure 6:
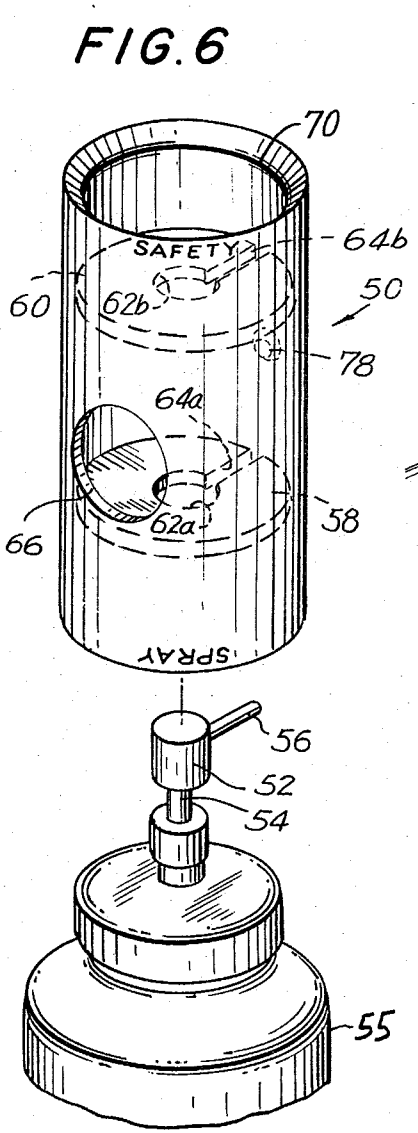
FIG. 6 is an isometric view similar to that of FIG. 1, but showing an altered design for the cap of the present invention.

A further alternative embodiment is shown in FIGS. 6–8, wherein container cap 50 is cylindrical and is defined to accommodate plunger 52 of container 55. Plunger 52 is mounted on a plunger stem 54 and includes an outwardly protruding plunger port 56. Cap 50 includes spacer discs 58 and 60, each defining a center port 62*a*, 62*b* and a plunger stem opening 64*a*, 64*b*. Furthermore, the wall of cap 50 defines finger port 66 and upper and lower openings 68, 70. Assuming, for the purposes of description, that the upper or spray position is depicted in FIG. 8, and the lower or safety storage position is depicted in FIGS. 6 and 7, it may been seen that both of spacer discs 58, 60 fit over and accommodate plunger 52 and plunger port 56. Therefore, in either inverted position, the cap will mate comfortably with container 55. However, in the safety position (FIGS. 6 and 7) finger port 66 is positioned in a manner so that the finger 72 of the user abuts the side 74 of plunger 52 rather than the top 76 thereof; whereas in the FIG. 8 spray position, finger 72 reaches through port 66 to abut the top 76 of plunger 52. Also, in the FIG. 8 position, plunger port 56 lines up with outlet opening 78, whereas in the FIGS. 6 and 7 position, it does not line up with such opening 78.

In order to provide a more complete description of the present invention, a series of operational steps will now be provided. On the store shelf and in storage position, the cap is oriented as shown in FIG. 5 with stop means 42 in position to prevent downward motion of the plunger disc 36 toward the dispensing stem 18. In order to provide actuation orientation, handles 44 are grasped and the cap 20 inverted so that lip 24 is secured to the container. In this orientation, access tube 40 overlies dispensing stem 18 and insertion of the user's finger through opening 46 can cause depression of plunger disc 36 and thereby dispensing stem 18 will release the contents.

What is claimed is:

1. A cap invertible for changing a dispensing container, having an actuation means for causing dispensing when depressed, from a use to a storage orientation, comprising a generally cylindrical outer housing, plunger disc movable relative to said outer housing for causing said dispensing, stop means for said plunger disc protruding inwardly from said outer housing, top and bottom lips defining top and bottom openings for connecting said cap to said container in both a use orientation with said stop means inoperative and a storage orientation with said stop means operative respectively.

2. A cap for a dispensing container having an actuation means for causing dispensing when depressed comprising a generally cylindrical outer housing, stop means protruding inwardly from said outer housing, top and bottom lips defining top and bottom openings for connecting said cap to said container in both a use orientation and a storage orientation, said cap further including a partially separated plunger assembly having an elongated outlet port protruding through said outer housing and terminating proximate the center thereof, an access tube continuing said outlet port and downwardly depending from said center termination thereof and a plunger disc connected to said outlet port and on the top thereof for depressing same, said container providing as said actuation means an upwardly extending dispensing stem and said access tube overlying said stem during use orientation of said cap.

3. The invention according to claim 2 wherein said inverted orientation of said cap provides said plunger disc above said stop means to thereby limit downward depression of said disc to prevent depression of said stem.

4. The invention according to claim 3 wherein said outer housing defines a finger access opening.

5. The invention according to claim 4 wherein said stem has a side surface and a top surface and said top surface is not depressable through said finger access opening in said storage orientation.

* * * * *